US006199468B1

(12) United States Patent
Hackbarth et al.

(10) Patent No.: US 6,199,468 B1
(45) Date of Patent: Mar. 13, 2001

(54) PROFILE CUTTING MACHINE

(75) Inventors: Jan Hackbarth, Herzogenrath; Claus Schiffler, Aachen, both of (DE)

(73) Assignee: Fecken-Kirfel GmbH & Co. Maschinenfabrik, Aachen (DE)

( * ) Notice: Subject to any disclaimer, the term of this patent is extended or adjusted under 35 U.S.C. 154(b) by 0 days.

(21) Appl. No.: 09/202,920

(22) PCT Filed: Jun. 5, 1997

(86) PCT No.: PCT/EP97/02916

§ 371 Date: Dec. 23, 1998

§ 102(e) Date: Dec. 23, 1998

(87) PCT Pub. No.: WO97/49530

PCT Pub. Date: Dec. 31, 1997

(30) Foreign Application Priority Data

Jun. 24, 1996 (DE) ..... 296 10 945 U

(51) Int. Cl.[7] ..... B26D 1/48

(52) U.S. Cl. ..... 83/820; 83/814; 83/788; 451/182

(58) Field of Search ..... 83/820, 814, 788; 451/358, 177, 182; 125/13.01, 16.02

(56) References Cited

U.S. PATENT DOCUMENTS

| | | | | |
|---|---|---|---|---|
| 473,468 | * | 4/1892 | Landis | 83/814 |
| 499,162 | * | 6/1893 | Emerson | 83/818 |
| 2,711,195 | * | 6/1955 | Hill | 83/788 |
| 2,843,917 | * | 7/1958 | Crane et al. | 83/797 |
| 3,263,537 | * | 8/1966 | Rehman et al. | 83/820 |
| 3,350,969 | * | 11/1967 | Wiatt et al. | 83/792 |
| 4,030,386 | * | 6/1977 | Poetzsch et al. | 83/820 |
| 4,915,000 | * | 4/1990 | MacFarlane | 83/651.1 |
| 5,001,957 | * | 3/1991 | Steckler | 83/792 |

FOREIGN PATENT DOCUMENTS

| | | | | |
|---|---|---|---|---|
| 004204445-A1 | * | 8/1993 | (DE) | 83/788 |
| WO 88/09249 | * | 12/1988 | (FR) | 83/788 |
| 0039112 | * | 2/1987 | (JP) | 83/788 |

* cited by examiner

*Primary Examiner*—M. Rachuba
*Assistant Examiner*—Kim Ngoc Tran
(74) *Attorney, Agent, or Firm*—Diller, Ramik & Wight, PC

(57) ABSTRACT

The contour cutting machine comprises an endless circulating bandknife (22) which is guided around bandknife pulleys (30–34). To allow adjustment of the cutting strand (23) in the Y-direction, the bandknife (22) forms two loops (28,36) merging into each other, one (36) of these two loops serving for length compensation. The bandknife pulley (30) arranged at the transition from the second loop (36) to the first loop (28) guides the bandknife (22) therearound at a looping angle of substantially 270° so that all of the bandknife pulleys (30–34) are contacted by the same surface of the bandknife (22). The bandknife (22) will always be bent in one direction only. By thus avoiding alternating bending directions, the lifespan of the bandknife (22) is lengthened.

13 Claims, 2 Drawing Sheets

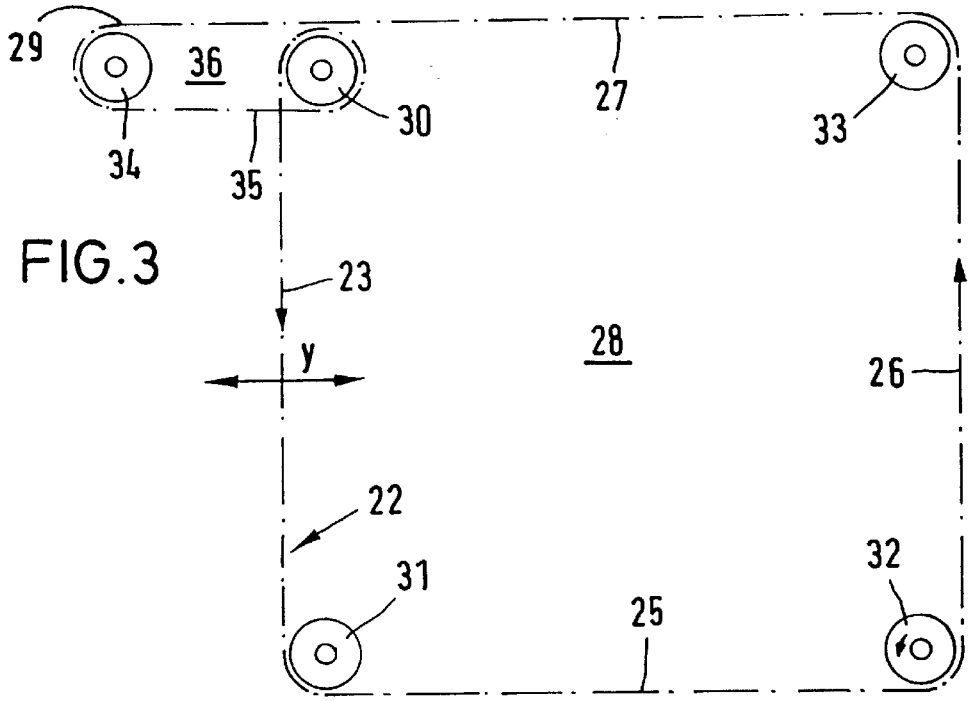
FIG.3
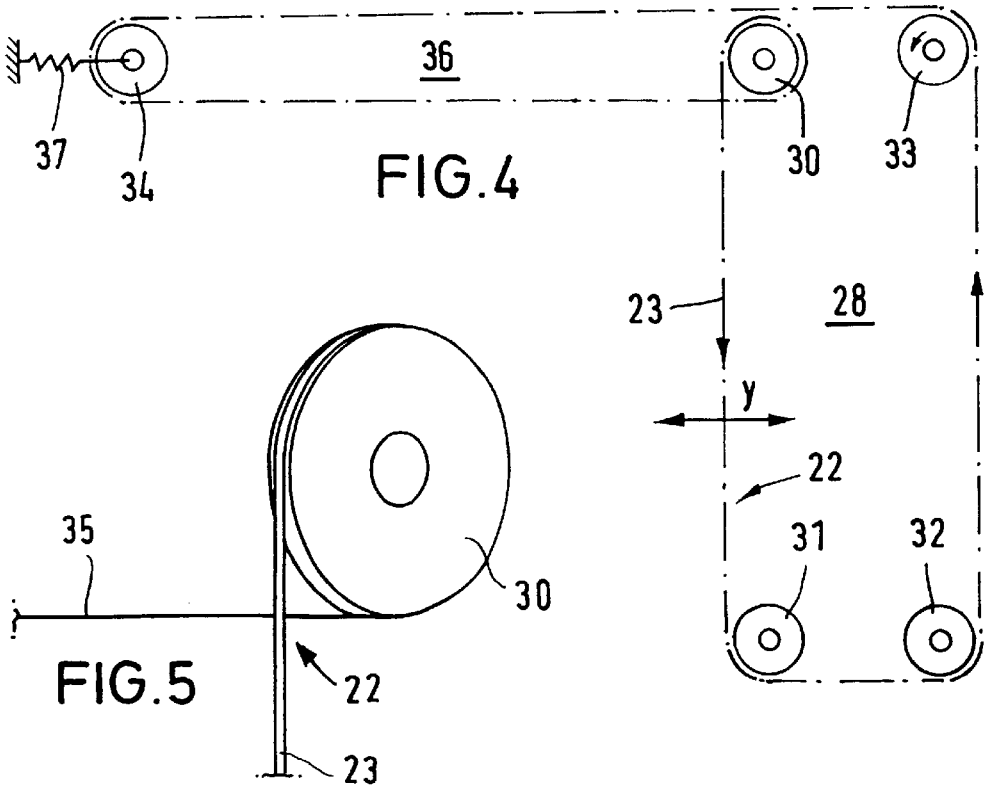
FIG.4
FIG.5

PROFILE CUTTING MACHINE

BACKGROUND OF THE INVENTION

This invention relates to a contour cutting machine for the cutting of objects, such as e.g. blocks made from foamed plastic, wadding, synthetic material, rubber or cork, comprising a rotating endless bandknife.

A contour cutting machine according to the precharacterizing part of claim 1 is known from DE 23 29 238 C2. This machine comprises a table for receiving the workpiece block, and a support arranged for vertical movement relative to the table. On the support, vertically movable carriages are arranged to both sides of the table. An endless bandknife is arranged to rotate around a plurality of bandknife pulleys, wherein respectively one bandknife pulley is located on one of the movable carriages and the rest of the bandknife pulleys are fixed to the machine. The bandknife is guided in a closed loop, with a first portion of the loop arranged between the two vertically adjustable bandknife pulleys while forming a cutting strand in this region. The first loop portion is of a rectangular shape and has the second loop portion extending therefrom which is guided around a fifth bandknife pulley and is used for a length compensation of the bandknife in case of different cutting heights. The fifth bandknife pulley is engaged by a tensioning device for setting the tension of the bandknife. On both end portions of the cutting strand, the respective carriages are provided with rotating devices for rotating the plane of the bandknife so as to change the cutting angle. In this bandknife guiding configuration comprising two loop portions merging into each other, the bandknife has its inner side contacting a total of four bandknife pulleys and has its outer side contacting one of the bandknife pulleys. As a result, the bandknife during its continuous circulation is subjected to varying alternating bending stresses which are directed both towards its inner face and towards its outer face. Due to these alternating bending stresses in combination with the torsional stresses generated by the rotating devices and the tensioning of the bandknife in the longitudinal direction, the bandknife suffers considerable mechanical stresses so that the bandknife may undesirably break and has a reduced lifespan.

A contour cutting machine comprising a cutting wire with a similar cutting wire guiding configuration is known from GB 2 206 521 A. In this known machine, a cutting wire is guided to follow mutually contacting loops, thereby running around pulleys deflecting the cutting wire alternately into one direction and a direction opposite thereto.

EP-0 390 939 B1 discloses a contour cutting machine wherein the bandknife is driven to oscillate. The ends of the bandknife are connected to a string. The bandknife and the string together form an endless loop comprising two loop portions merging into each other. The guiding of this loop requires at least six pulleys formed as bandknife pulleys and string pulleys. Also there, the loop is guided around pulleys deflecting the bandknife or the string alternately into one direction and a direction opposite thereto.

Further, DE 34 44 612 C2 discloses a contour cutting machine wherein the workpiece table comprises two conveyor belts arranged in a common plane, which are driven synchronously and form a gap for the passage of a cutting wire. The cutting wire is guided around four pulleys which are arranged on a frame adapted to be displaced and pivoted in its entirety. The cutting wire guiding path forms a single closed loop. When performing a contour cutting process, the whole frame, having a large mass moment of inertia, has to be moved.

SUMMARY OF THE INVENTION

It is an object of the invention to provide a contour cutting machine having an endlessly rotating bandknife, wherein only small masses need be moved for positioning the cutting strand and wherein the bandknife is subjected to relatively small stresses and thus has a large lifespan.

In the contour cutting machine according to the instant invention, the bandknife is guided to follow two loops merging into each other and overlapping each other on that bandknife pulley which connects the loops. The first loop is generally rectangular and comprises four bandknife pulleys, notably two fixed bandknife pulleys and two bandknife pulleys arranged to be displaced together and having the cutting strand extending therebetween. Extending from the first loop is a second loop as a compensating loop guided around a fifth bandknife pulley. In this manner, it is accomplished that the overall length of the bandknife string will remain constant in each position of the displaceable bandknife pulleys. According to the invention, the bandknife is guided at a looping angle of substantially 270° around said displaceable bandknife pulley connecting the two loops, each bandknife pulley being contacted by the same surface of the bandknife. In this manner, it is provided that the bandknife throughout its circulating movement through the two loops will always be bent in the same direction only. Thus, no alternating bending will occur during the circulating movement of the bandknife. Since the bandknife is always bent into one direction only (and not in the opposite direction), the mechanical stress acting on the bandknife is a mere threshold stress and thus is relatively small, so that the lifespan of the bandknife will be considerably longer than that of a bandknife undergoing alternating bending directions.

The inventive configuration of the moving path of the bandknife is applicable in contour cutting machines with any possible orientation of the cutting strand, i.e. also in machines wherein the cutting strand is oriented vertically and in machines with a horizontal cutting strand. Further, the whole worktool carrier can be arranged to be adjusted and pivoted, respectively, so that the cutting strand is arranged obliquely to a vertical line.

An embodiment of the invention will be described in greater detail hereunder with reference to the accompanying drawings.

BRIEF DESCRIPTION OF THE DRAWINGS

FIG. 3 is a schematic view of the moving path of the bandknife in a first position of the cutting strand, FIG. 4 is a view of the moving path of the bandknife in a second position of the cutting strand, and FIG. 5 is a view of that bandknife pulley which guides the bandknife at a large looping angle.

DESCRIPTION OF THE PREFERRED EMBODIMENTS

Figure 1:
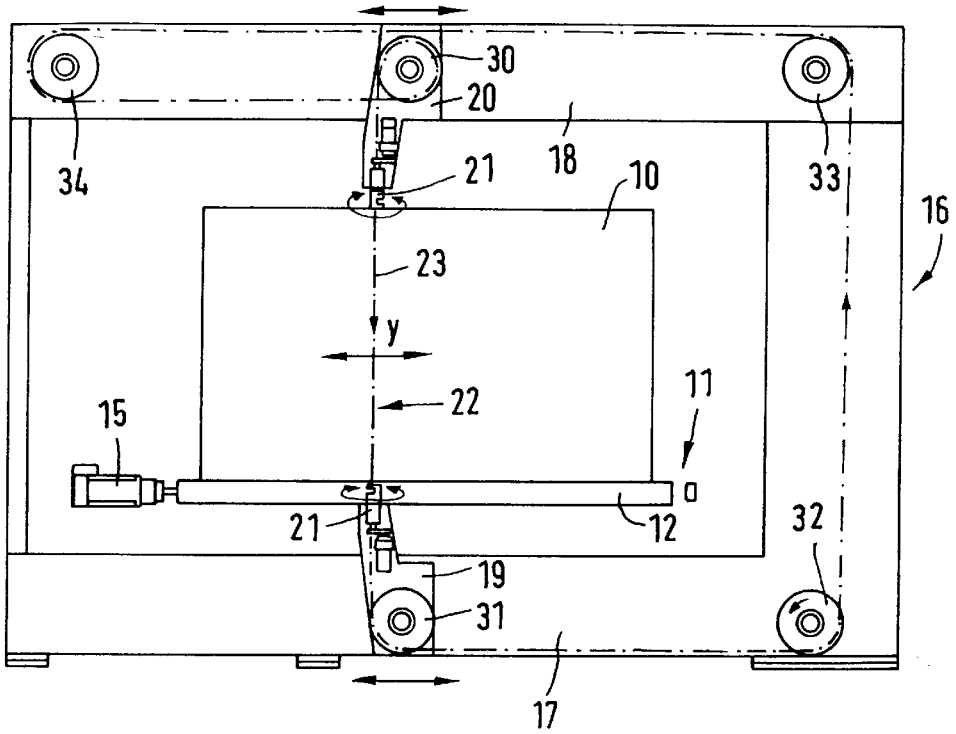
FIG. 1 is a front view of the contour cutting machine.
Figure 2:
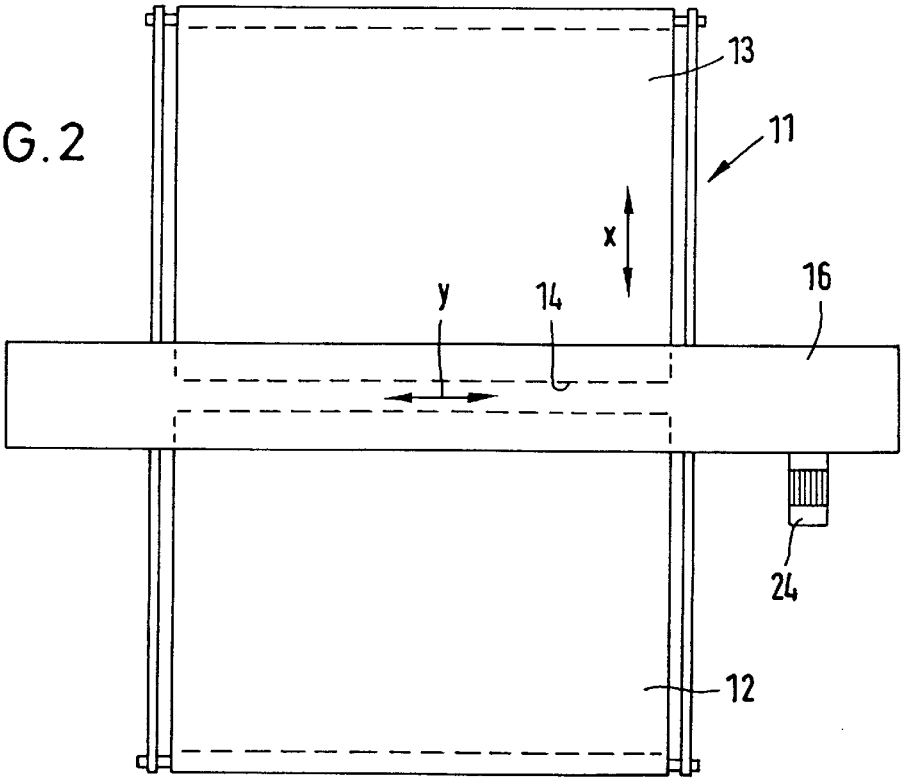
FIG. 2 is a plan view of the machine.

The contour cutting machine is provided for the cutting of blocks 10 of foamed material or similar materials. The block 10 is placed onto a workpiece carrier 11 comprising two conveyor belts 12,13 which are arranged in a common plane and can be driven in synchronism with each other and perform a conveying motion in the direction X. Between the successive conveyor belts 12,13, a gap 14 is formed for the passage of the bandknife. The two conveyor belts 12,13 are driven by a common motor 15.

The workpiece carrier 11 is encompassed by a frame 16 fixed to the machine and comprising a lower bar 17 arranged below workpiece carrier 11 and an upper bar 18 arranged in parallel to lower beam 17. Along each bar, a carriage 19,20 is arranged to be displaced in the Y-direction. The two carriages 19,20 are driven in synchronism with each other, thus assuming always the same positions in the Y-direction.

On each of the carriages 19,20, a bandknife rotating device 21 is mounted, having a slot for passing the bandknife 22 therethrough. These bandknife rotating devices 21 guide the bandknife 22 and are controlled in such a manner that the face of bandknife 22 in the cutting strand 23 can be adjusted to a desired cutting angle, e.g. to the tangent angle of the cutting contour to be generated.

A bandknife pulley 30 is supported on the upper carriage 20, and a bandknife pulley 31 is supported on the lower carriage 19. From bandknife pulley 31, the bandknife 22 extends to a fixed bandknife pulley 32 supported on worktool carrier 16 and driven by a motor 24. From bandknife pulley 32, arranged at the same height as bandknife pulley 31, the bandknife 22 extends vertically upwards to a further bandknife pulley 33 supported on worktool carrier 16 where the bandknife 22 is deflected by substantially 90°. From bandknife pulley 33, the bandknife 22 extends above bandknife pulley 30 to a fifth bandknife pulley 34 arranged at the end of upper bar 18. Between bandknife pulleys 33 and 34, the carriage 20 is movable in the Y-direction.

FIG. 3 illustrates the moving path of the bandknife pulley 22 in a given Y-position of the cutting strand 23. In the cutting strand 23, the bandknife 22 is moved downwards from above in the direction of the arrow. The cutting strand 23 together with the bandknife portions 25,26,27 forms a first rectangular loop 28. Bandknife portion 27 is joined by a bandknife portion 29 leading to bandknife pulley 34, which bandknife portion 29 together with bandknife portion 35 leading from bandknife pulley 34 to bandknife pulley 30, forms the second loop 36 which constitutes a compensating loop. Loop 36 starts from the upper left corner of loop 28 in an outward direction, and its vertical dimension (loop height) is considerably smaller than that of first loop 28 and is substantially restricted to the diameter of bandknife pulley 34.

Lower bandknife portion 35 of loop 36 is guided horizontally to bandknife pulley 30 from below. This bandknife pulley 30 guides the bandknife 22 therearound at a looping angle of substantially 270° so that the bandknife 22 runs around bandknife pulley 30 and then moves in a downward direction to join the cutting strand 23. To prevent a collision of bandknife portions 27 and 29 with the bandknife portion guided around bandknife pulley 30, bandknife pulley 33 is suitably arranged somewhat higher than bandknife pulley 30.

FIG. 5 is a view of bandknife pulley 30. While all other bandknife pulleys are arranged in a common plane, bandknife pulley 30 is oriented at an inclination to this plane so that the outgoing cutting strand 23 will not collide with the incoming bandknife portion 35.

Each bandknife pulley is formed with an outwardly curved peripheral surface to keep the bandknife 22 from sliding off the bandknife pulley. Preferably, the peripheral surface is part of a spherical surface. Thus, the bandknife pulley can be imagined as a cut-out slice from a complete spherical body.

From FIGS. 3 and 4, it is evident that the two loops 28,36 form a closed circulation path for the bandknife and that, when the position of the cutting strand 23 is changed in the Y-direction, the length of this circulation path will still remain constant. To lend the bandknife the required bandknife tension in the longitudinal direction, bandknife pulley 34 is engaged by a tensioning device 37.

The bandknife pulleys 30,31,32,33 of the first loop 28 are generally arranged in the configuration of a rectangle, and the bandknife pulleys 30,33,34 are located substantially at the same height.

The bandknife circulation path can be realized with only five bandknife pulleys without excluding the possibility to provide a larger number of bandknife pulleys, if required. It is imperative that the bandknife on each of the bandknife pulleys of its circulation path will be bent in the same direction, thus avoiding alternating bending directions.

Although a preferred embodiment of the invention has been specifically illustrated and described herein, it is to be understood that minor variations may be made in the apparatus without departing from the spirit and scope of the invention, as defined the appended claims.

We claim:

1. A contour cutting machine comprising a circulating endless bandknife (22) guided around a plurality of bandknife pulleys (30–34) and extending in two loops (28, 36) merging into each other, a first loop (28) being guided around two fixed bandknife pulleys (32, 33) and around two displaceable bandknife pulleys (30, 31) which are substantially simultaneously displaceable, and a second loop (36) being guided around a further bandknife pulley (34), characterized in that said endless bandknife (22) is guided at a looping angle of substantially 270° around one pulley (30) of the displaceable bandknife pulleys (30, 31) which connects the two loops (28, 36), and all bandknife pulleys (30–34) being contacted by the same surface of the endless bandknife (22).

2. The contour cutting machine according to claim 1, characterized in that said one displaceable bandknife pulley (30) connecting said two loops (28, 36) is oriented at an inclination relative to the plane of the other bandknife pulleys so as to guide an incoming bandknife portion (35) of said endless bandknife (22) and an outgoing cutting strand (23) of said endless bandknife (22) past each other without collision.

3. The contour cutting machine according to claim 2, characterized in that the plurality of bandknife pulleys (30–34) are supported on a worktool carrier (16), and two conveyor belts (12, 13), separated from each other by a gap (14) for the passage of the endless bandknife (22), are provided for supporting material to be cut.

4. The contour cutting machine according to claim 1, characterized in that said two displaceable bandknife pulleys (30, 31) are arranged on synchronously moveable carriages (20, 19) which are each provide with rotating means (21) for varying a plane of the cutting strand (23) of the endless bandknife (22).

5. The contour cutting machine according to claim 4, characterized in that the plurality of bandknife pulleys (30–34) are supported on a worktool carrier (16), and two conveyor belts (12, 13), separated from each other by a gap (14) for the passage of the endless bandknife (22), are provided for supporting material to be cut.

6. The contour cutting machine according to claim 4, characterized in that said two displaceable bandknife pulleys (30, 31) are arranged on synchronously moveable carriages (20, 19) which are each provide with rotating means (21) for varying a plane of the cutting strand (23) of the endless bandknife (22).

7. The contour cutting machine according to claim 1, characterized in that the plurality of bandknife pulleys (30–34) are supported on a worktool carrier (16), and two conveyor belts (12, 13), separated from each other by a gap (14) for the passage of the endless bandknife (22), are provided for supporting material to be cut.

8. The contour cutting machine according to claim 1 characterized in that said endless bandknife (22) includes an incoming bandknife portion and an outgoing bandknife portion which cross each other at a point substantially diametrically opposite the midpoint of the substantially 270° looping of the endless bandknife (22) about said one pulley (30).

9. The contour cutting machine according to claim 8 wherein said substantially 270° looping about said one pulley (30) defines in part each of said two loops (28, 36).

10. The contour cutting machine according to claim 9 wherein said one pulley (30) is in a plane inclined to a plane of the remaining pulleys.

11. The contour cutting machine according to claim 8 wherein said one pulley (30) is in a plane inclined to a plane of the remaining pulleys.

12. The contour cutting machine according to claim 1 wherein said substantially 270° looping about said one pulley (30) defines in part each of said two loops (28, 36).

13. The contour cutting machine according to claim 12 wherein said one pulley (30) is in a plane inclined to a plane of the remaining pulleys.

* * * * *